US007255294B2

(12) United States Patent
Sweeton et al.

(10) Patent No.: US 7,255,294 B2
(45) Date of Patent: Aug. 14, 2007

(54) BATTERY OPERATED SPRAY HEAD HAVING AN IMPROVED HOUSING

(75) Inventors: Steve L. Sweeton, Lake Winnebago, MO (US); Linn D. Wanbaugh, Blue Springs, MO (US); David DeJong, West Olive, MI (US)

(73) Assignee: MeadWestvaco Corporation, Glen Allen, VA (US)

( * ) Notice: Subject to any disclaimer, the term of this patent is extended or adjusted under 35 U.S.C. 154(b) by 85 days.

(21) Appl. No.: 11/128,840

(22) Filed: May 13, 2005

(65) Prior Publication Data

US 2006/0153708 A1 Jul. 13, 2006

Related U.S. Application Data

(63) Continuation-in-part of application No. 11/034,600, filed on Jan. 13, 2005.

(51) Int. Cl.
*A62C 11/00* (2006.01)

(52) U.S. Cl. ..... 239/333; 239/332; 239/351; 239/360; 239/526; 222/333; 417/411

(58) Field of Classification Search ..... 239/332, 239/337, 333, 331, 329, 340, 347, 348, 349, 239/354, 526, 525, 527, 360, 302, 351, DIG. 14; 222/212, 214, 333, 383.1, 385; 417/411
See application file for complete search history.

(56) References Cited

U.S. PATENT DOCUMENTS

| | | | | |
|---|---|---|---|---|
| 3,173,584 | A | 3/1965 | Giavasis | |
| 3,255,967 | A | 6/1966 | Kenney | |
| 3,901,449 | A | 8/1975 | Bochmann | |
| 3,993,250 | A | 11/1976 | Shure | |
| 4,721,439 | A | 1/1988 | Leinweber | |
| 4,790,454 | A | 12/1988 | Clark et al. | |
| 4,835,452 | A | 5/1989 | Kuriyama | |
| 5,150,841 | A | 9/1992 | Silvenis et al. | |
| 5,397,034 | A | 3/1995 | Wunsch | |
| 5,716,007 | A * | 2/1998 | Nottingham et al. | 239/332 |
| 6,554,211 | B1 * | 4/2003 | Prueter et al. | 239/332 |
| 6,752,330 | B2 * | 6/2004 | DiMaggio et al. | 239/337 |
| 6,811,099 | B2 * | 11/2004 | Krestine et al. | 239/524 |
| 6,981,658 | B2 | 1/2006 | Streutker et al. | |
| 7,032,841 | B1 | 4/2006 | Swisher | |
| 2006/0076434 | A1 | 4/2006 | Hornsby et al. | |
| 2006/0076435 | A1 | 4/2006 | Hudson et al. | |

* cited by examiner

*Primary Examiner*—Dinh Q. Nguyen
(74) *Attorney, Agent, or Firm*—Gordon & Jacobson, PC

(57) ABSTRACT

A three part housing for a battery powered spray head includes a left half shell, a right half shell and a hinged top. The batteries are located in the upper portion of the housing below the hinged top (battery cover). The inner front of the top is provided with a downward depending latch member and a spring biased latch member is provided inside the housing. The spring biased latch member is actuated by inserting a pin (or stylus) through a hole in one of the half shells. This prevents accidental opening of the battery cover.

14 Claims, 9 Drawing Sheets

BATTERY OPERATED SPRAY HEAD HAVING AN IMPROVED HOUSING

CROSS-REFERENCE TO RELATED APPLICATIONS

This application is a continuation-in-part of U.S. patent application Ser. No. 11/034,600, entitled "Battery Operated Spray Head Retrofittable onto Existing Pump Spray Containers and Producing Substantially Continuous Spray," filed Jan. 13, 2005, the complete disclosure of which is hereby incorporated herein by reference.

BACKGROUND OF THE INVENTION

1. Field of the Invention

This invention relates broadly to battery operated fluid pumps. More particularly, this invention relates to a battery operated fluid pump contained in a spray head.

2. State of the Art

Many household and industrial products are sold in containers that include a sprayer. These products include cleansers, insecticides, polishes, waxes, etc. There are several kinds of sprayers used with these products. Perhaps the most common is the manual push button or trigger operated pump which is seen most frequently on liquid cleansers. It has the advantage of being environmentally friendly (i.e. it does not require a propellant) but the disadvantage of delivering fluid in a series of pulses rather than in a continuous spray. Another well known sprayer is the aerosol can which is sealed and charged with a gas propellant. This sprayer has the advantage that it dispenses fluid in a continuous spray, but has several disadvantages. One disadvantage is that the can cannot be refilled. Another disadvantage is that depending on the gas used to charge the container, the propellant can be environmentally unfriendly. While environmentally friendly propellants do exist, generally, they do not charge as well as the unfriendly gases. Still another popular sprayer is the air pump sprayer seen most frequently with insecticides and liquid garden products. The pump sprayer includes a hand operated air pump which is used to charge the container with compressed air. After it is charged, it operates much like an aerosol can. The pump sprayer is environmentally friendly but requires considerable effort to keep charged because air is not as efficient a propellant as environmentally unfriendly gases such as FREON or hydrocarbon gasses.

In recent years there has been some experimentation with battery powered pump sprayers. Most of these devices include a spray mechanism which is similar to the ubiquitous push button (or trigger) pump sprayer but which is coupled to a battery powered electric motor by some type of linkage which converts the rotary action of the motor into an oscillatory motion to drive the pump piston. Many of these battery operated pump sprayers are designed to work only with a specially constructed bottle, i.e. they are not retrofittable to existing pump spray bottles. Many also have weight distribution problems, i.e. they cause the bottle to which they are attached to tip over. Many of these battery powered pumps have large priming volumes, thus causing a delay between the time the pump is activated and the time liquid begins to be dispensed. Significantly, these pumps do not really provide a constant spray. They provide a continuous pulsed spray like that obtained by repeatedly squeezing the trigger or pushing the button on a hand operated spray pump. This is apparently one reason why such battery operated sprayers have not had commercial success.

Parent application Ser. No. 11/034,600 discloses a battery operated spray pump which includes a piston pump having a double end cam which is pushed by a pair of rotating cam pushers coupled to the electric motor via a gear transmission. The double end cam has an unequal duty cycle, i.e. takes more time to expel fluid from the piston cylinder than it takes to fill the cylinder. The cam pushers rotate at a speed which, in conjunction with the duty cycle of the cam, produces a low pressure nearly constant stream. According to the presently preferred embodiment, the duty cycle of the cam is approximately 270° and the speed of the cam pushers is approximately three rpm.

While the battery operated pump sprayer of the parent application provides significant improvement over the art, in order to obtain commercial success, not only do the pumping issues need to be addressed, but other issues regarding the batteries need to be properly addressed. For example, it is important that the battery cover protect the batteries from liquids. It is also important that the battery cover not easily detach unintentionally.

SUMMARY OF THE INVENTION

It is therefore an object of the invention to provide a battery operated spray head.

It is another object of the invention to provide a battery operated spray head housing which protects the batteries from liquid.

It is a further object of the invention to provide a battery operated spray head housing with a battery compartment cover that resists inadvertent removal.

In accord with these objects, which will be discussed in detail below, a battery operated spray head according to the invention includes an electric pump assembly with a drive train, an inlet and outlet port assembly, an inlet tube, a trigger, a microswitch, battery contacts, a threaded closure, and a closure retainer. A three part housing contains the pump assembly, drive train, most of the inlet and outlet port assembly, the microswitch, and two AA batteries. The trigger is coupled to the bottom front of the housing. The closure retainer is coupled to the bottom of the housing behind the trigger with the closure and the inlet tube depending therefrom.

The three part housing includes a left half shell, a right half shell and a hinged top. The batteries are located in the upper portion of the housing below the hinged top (battery cover). The left half shell and the right half shell are coupled to each other by three self tapping screws which extend through three holes in the right half shell and engage three cylindrical posts in the left half shell. An additional post located at the bottom rear of the housing acts as a hinge axle for the top. Thus it will be appreciated that the hinged top covers most of the back of the housing as well.

According to one aspect of the invention, the inner front of the top is provided with a downward depending latch member and a spring biased latch member is provided inside the housing. The spring biased latch member is actuated by inserting a pin (or stylus) through a hole in one of the half shells. This prevents accidental opening of the battery cover. It also prevents children from opening the cover and accessing the interior of the housing. As used herein, the term "stylus" shall means any object which is dimensioned to fit into the hole and actuate the latch member.

According to another aspect of the invention, the upper edges of the half shells are provided with flanges which are received inside the cover when the cover is closed. The left and right half shells are also provided with a gutter-like structure (hereinafter "gutter") adjacent to the battery cover which extend across the sides and down the back of the housing.

Additional objects and advantages of the invention will become apparent to those skilled in the art upon reference to the detailed description taken in conjunction with the provided figures.

DETAILED DESCRIPTION

Figure 1:
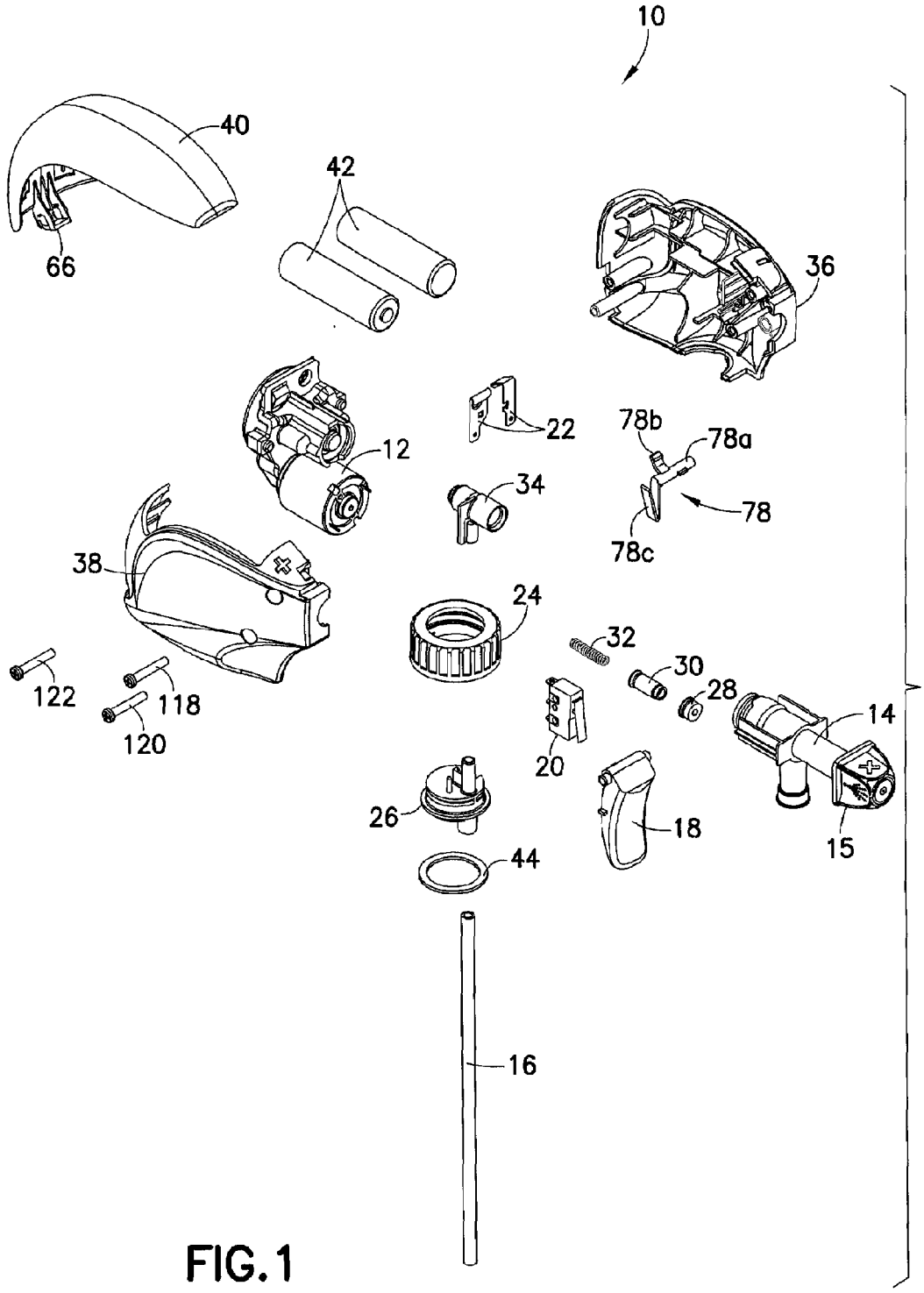
FIG. 1 is an exploded perspective view of a battery operated spray head incorporating a housing according to the invention.

Turning now to FIG. 1, a battery operated spray head 10 according to the invention includes an electric pump assembly with a drive train 12, an inlet and outlet port assembly 14 including a nozzle 15, a substantially rigid inlet tube 16, a trigger 18, a microswitch 20, battery contacts 22, a threaded closure 24, and a closure retainer 26. The trigger 18 is arranged to engage the microswitch 20 and a vent assembly which includes a vent piston 28, a product valve 30, a vent spring 32, and a vent housing 34. A three part housing 36, 38, 40 contains the pump assembly and drive train 12, most of the inlet and outlet port assembly 14 (except for the nozzle 15), the microswitch 20, the vent components 28-34, the battery contacts 22, and two AA batteries 42. The trigger 18 is coupled to the bottom front of the housing. The closure retainer 26 is coupled to the bottom of the housing behind the trigger with the closure 24 and the inlet tube 16 depending therefrom. A closure gasket 44 is received inside the closure 24.

Figure 1A:
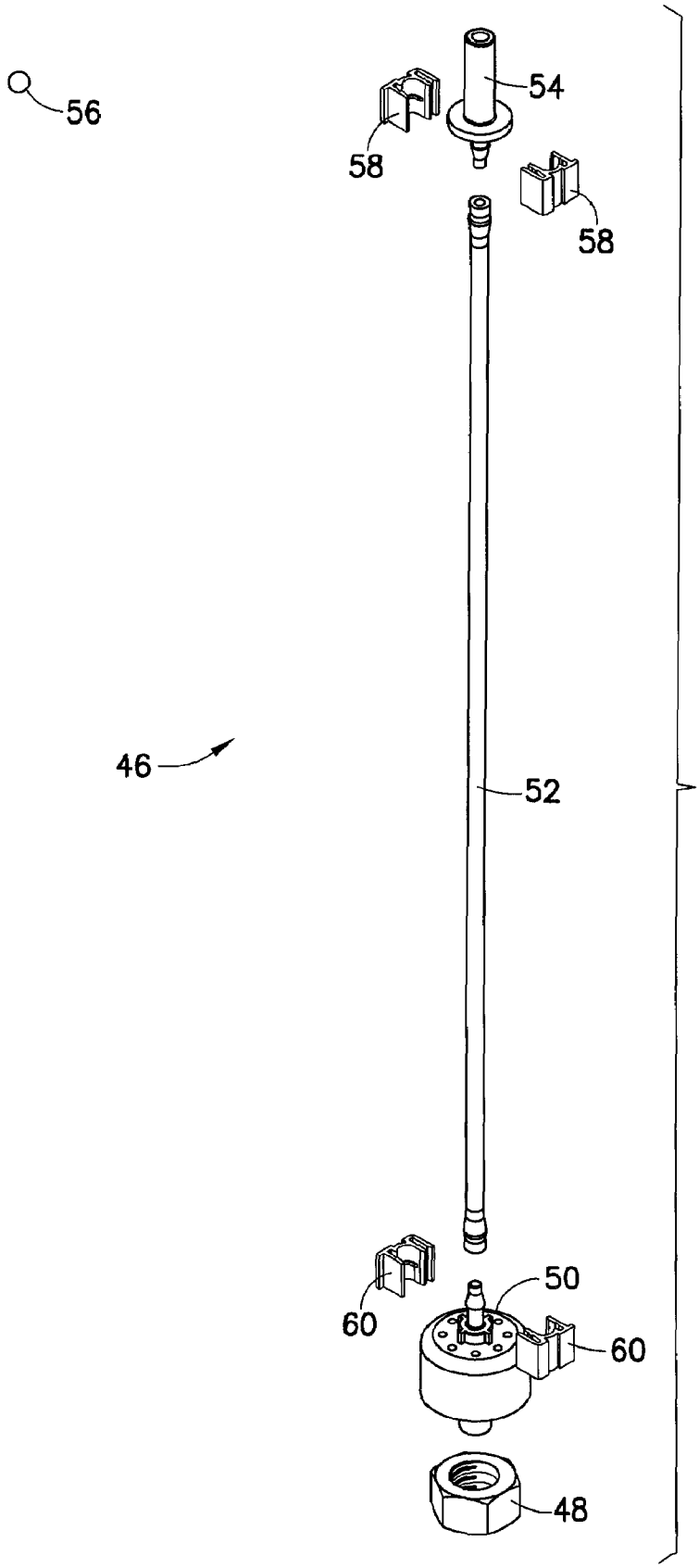
FIG. 1A is an exploded perspective view of an optional inlet tube assembly.
Figure 2:
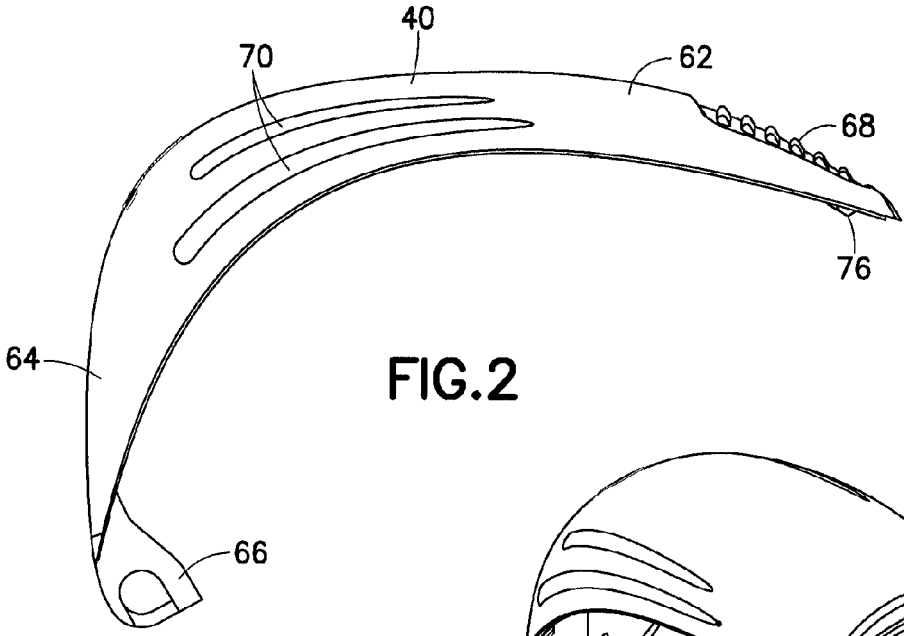
FIG. 2 is a side elevational view of a battery cover according to the invention.
Figure 2A:
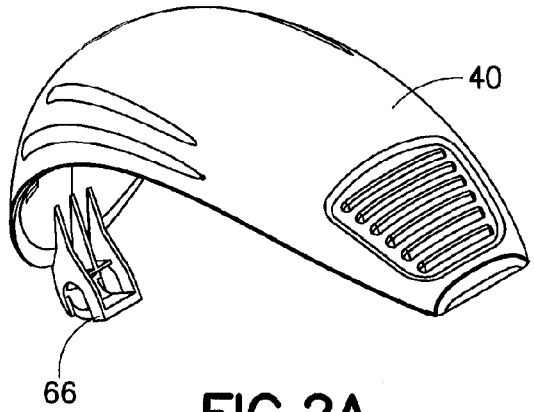
FIG. 2A is a perspective view of the battery cover of FIG. 2.
Figure 2B:
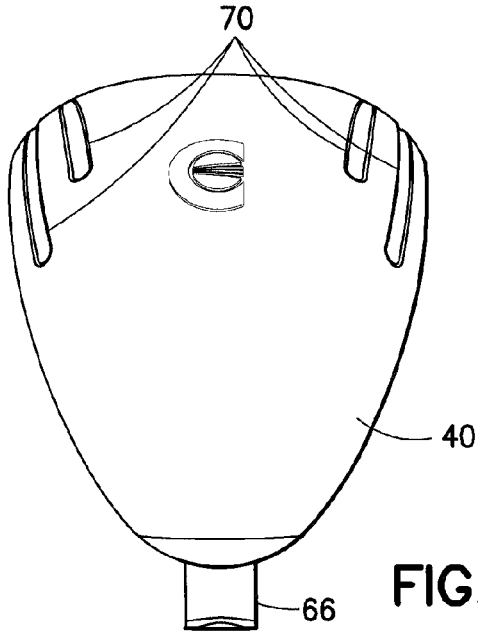
FIG. 2B is a rear elevational view of the battery cover of FIG. 2.
Figure 2E:
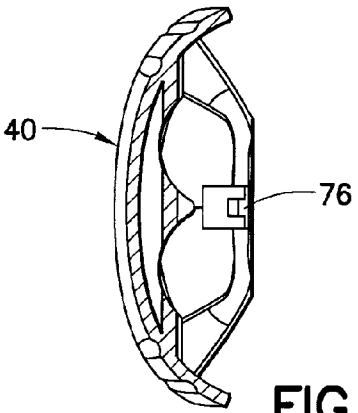
FIG. 2E is a section taken along line 2E-2E in FIG. 2C.
Figure 2F:
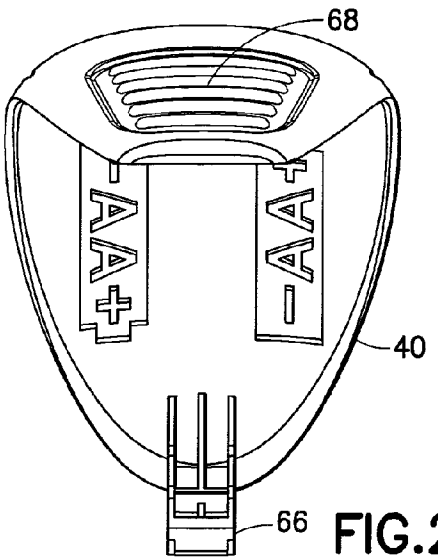
FIG. 2F is a front elevational view of the battery cover.
Figure 2C:
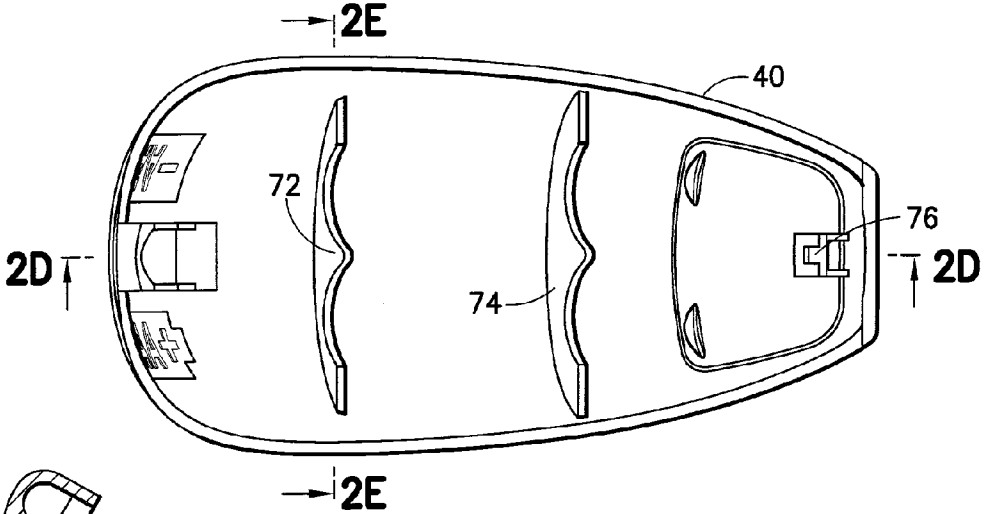
FIG. 2C is a bottom view of the battery cover of FIG. 2.
Figure 2D:
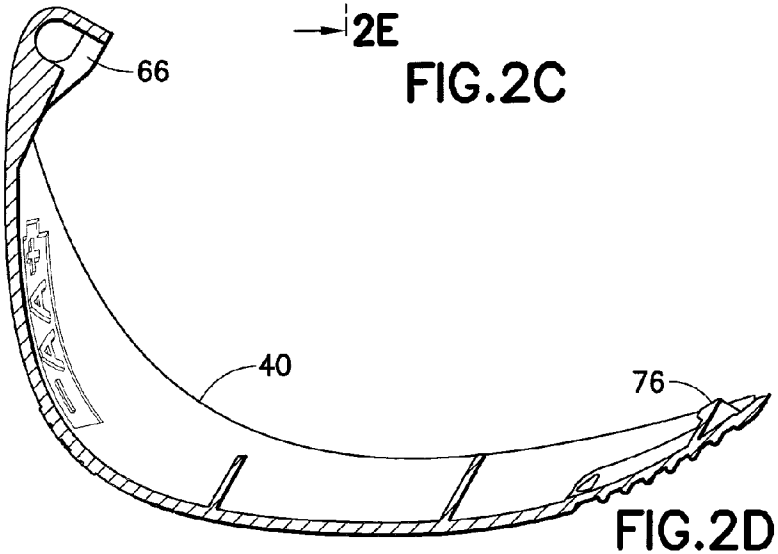
FIG. 2D is a section taken-along line 2D-2D in FIG. 2C.
Figure 3:
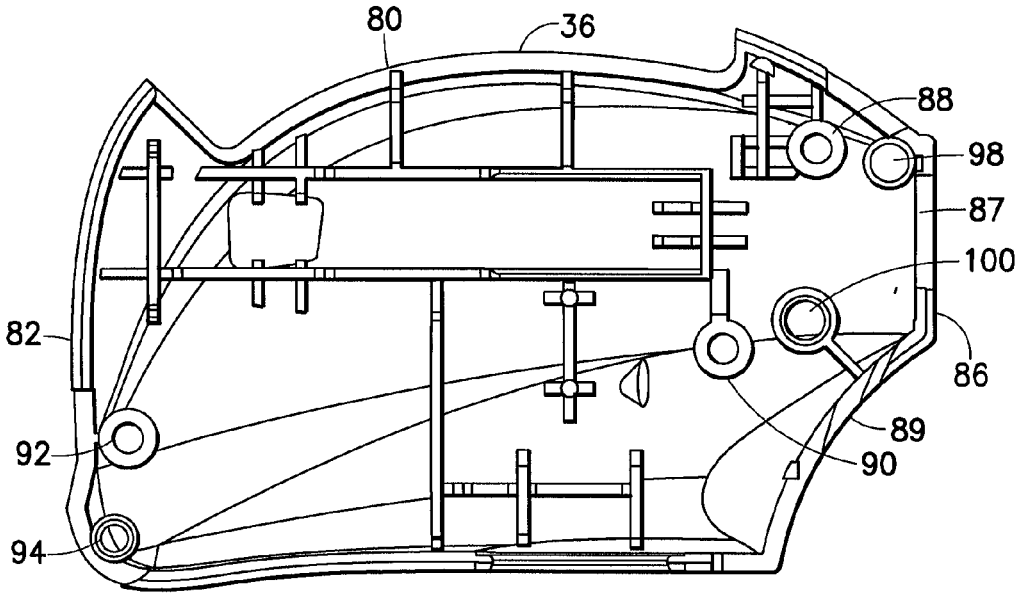
FIG. 3 is an inside elevational view of a left hand housing component according to the invention.
Figure 3A:
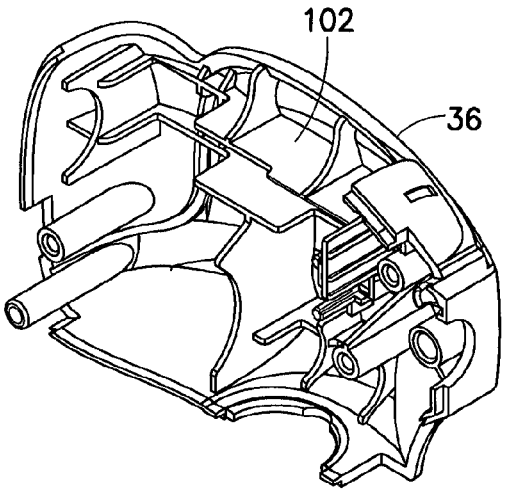
FIG. 3A is a perspective view of the left hand housing component of FIG. 3.
Figure 3B:
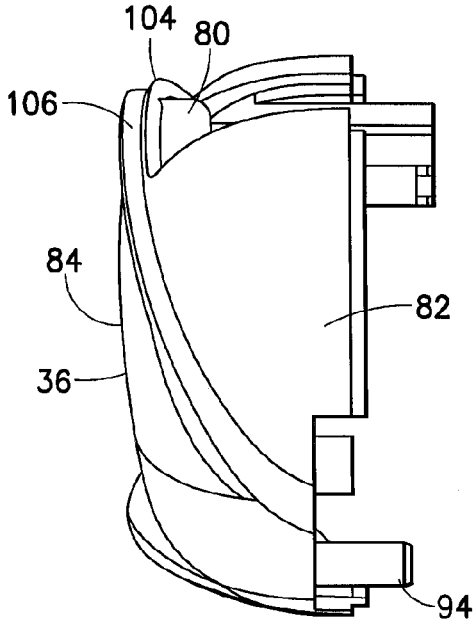
FIG. 3B is a rear elevational view of the left hand housing component of FIG. 3.
Figure 3C:
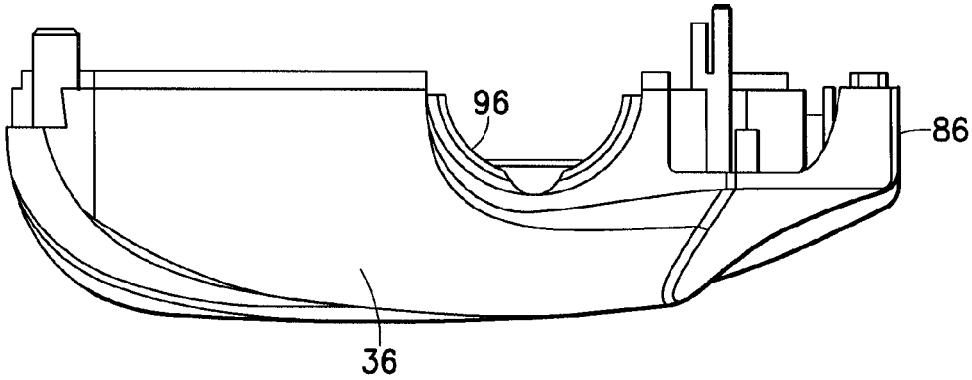
FIG. 3C is a bottom plan view of the left hand housing component of FIG. 3.
Figure 3D:
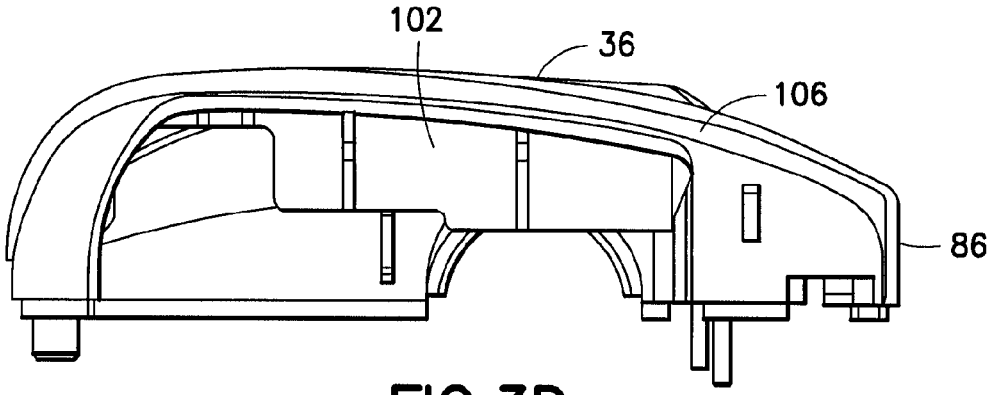
FIG. 3D is a top plan view of the left hand housing component of FIG. 3.
Figure 3E:
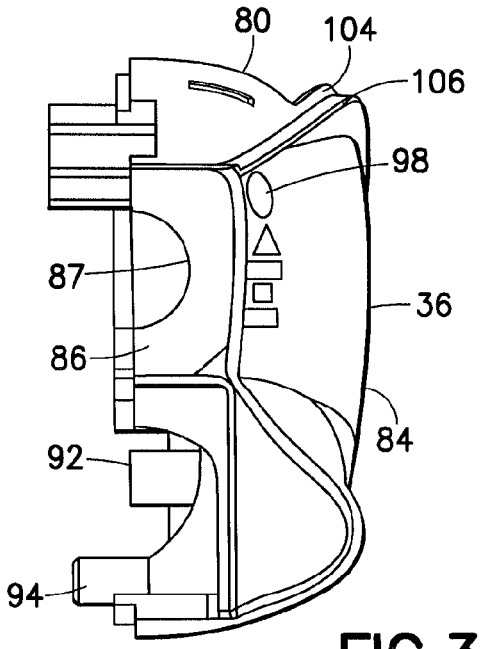
FIG. 3E is a front elevational view of the left hand housing component of FIG. 3.
Figure 4:
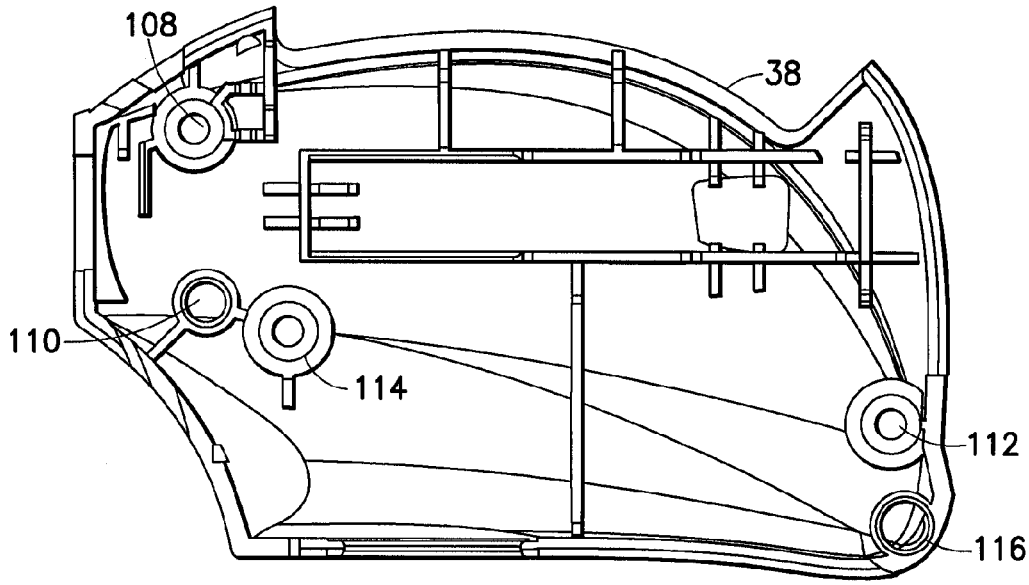
FIG. 4 is an inside elevational view of a right hand housing component according to the invention.
Figure 4A:
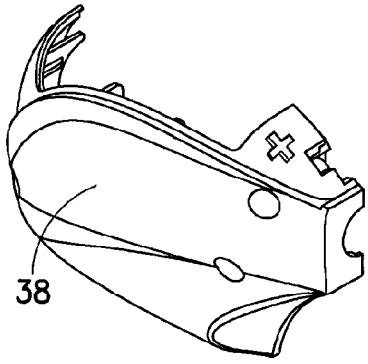
FIG. 4A is a perspective view of the right hand housing component of FIG. 4.
Figure 4B:
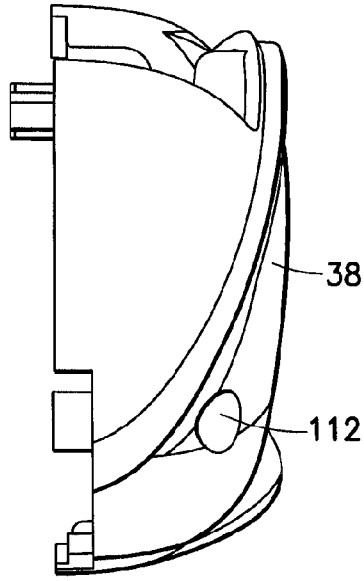
FIG. 4B is a rear elevational view of the right hand housing component of FIG. 4.
Figure 4C:
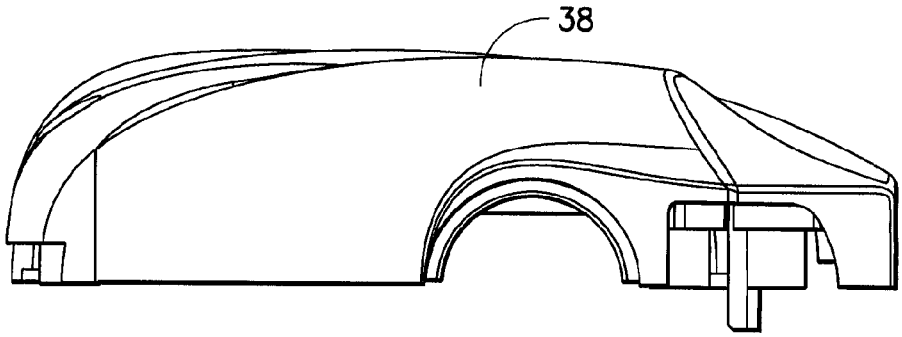
FIG. 4C is a bottom plan view of the right hand housing component of FIG. 4.
Figure 4D:
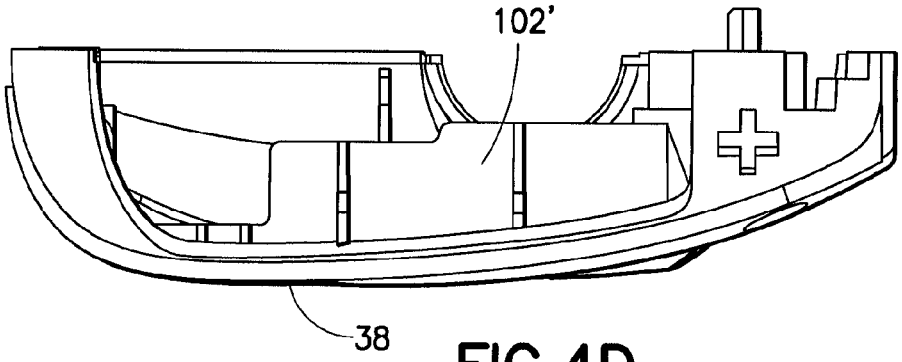
FIG. 4D is a top plan view of the right hand housing component of FIG. 4.
Figure 4E:
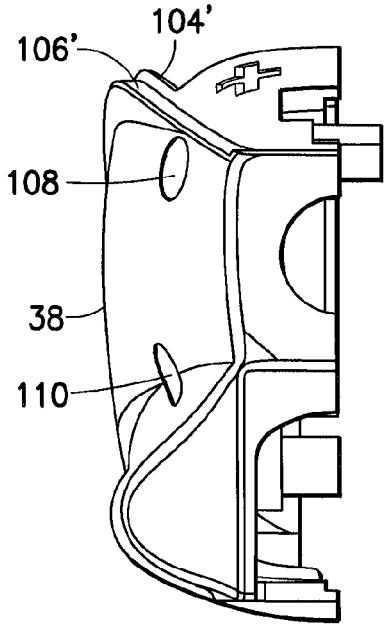
FIG. 4E is a front elevational view of the right hand housing component of FIG. 4.

Before turning to the details of the housing, it is noted that FIG. 1A shows an optional inlet tube assembly 46 which allows the pump to be operated in an inverted position. The assembly 46 includes a nut 48 which acts as a weight, a weight adapter 50, a flexible tube 52, a tube adapter/inlet port 54 and a ball 56. The tube 52 is coupled to the tube adapter by a two piece tube retainer 53 and is coupled to the weight adapter 50 by a two piece tube retainer 60. The ball 56 resides in the inlet port and acts as a one-way valve. When the spray head 10 is equipped with the inlet tube assembly 46 and attached to a bottle of liquid to be sprayed, the weight 48 assures that the end of the inlet tube 52 remains submersed in the liquid even if the bottle and spray head are inverted.

The three part housing includes a left half shell 36, a right half shell 38 and a hinged top 40. FIGS. 2 and 2A-2F illustrate details of the top 40. It is generally scoop-shaped having a convex outer wall upper portion 62 which sweeps down to a convex back 64, the end of which supports a hinge member 66. According to the illustrated embodiment, the front of the top 62 is provided with a friction gripping surface 68. From the middle to the rear of the top 62 are four grooves 70 which extend onto the back 64. There are two ribs 72, 74 on the interior of the cover 40 (which embrace batteries) and at the front end of the interior is a catch 76 which interacts with a latch (78 in FIG. 1) as described in detail below. The latch 78 has a cylindrical member 78*a* from which a radially extending catch member 78*b* extends. An integral spring 78*c* is provided at one end of the cylindrical member 78*a*.

The left half shell 36 is illustrated in FIGS. 3 and 3A-3E. The half shell 36 has an open top 80 with a generally convex edge that slopes back to a convex back 82. The outer side 84 is also convex from top to bottom and from front to back. The front 86 is generally flat in the upper portion which defines half a hole 87 for the inlet and outlet port assembly (14 in FIG. 1) and curves in a lower portion which defines half an opening for the trigger (18 in FIG. 1). The interior presents three hollow connecting posts 88, 90, and 92 for coupling the left half shell with the right half shell. A cover axle 94 is located at the extreme bottom rear of the half shell, beneath the connecting post 92. The bottom defines a half hole 96 for mounting the closure retainer (26 in FIG. 1). A through bore 98 is located in the extreme upper front of the half shell just forward of the connecting post 88 and a trigger pivot support 100 extends along side the connecting post 90. The through bore 98 is arranged to receive a portion of the cylindrical member 78*a* (FIG. 1) of the latch 78. A battery shelf 102 is located below the upper opening 80. The upper opening 80 is provided with an upstanding flange 104 extending from the front to the back of the opening. On the exterior of the half shell, beneath the flange 104 is a gutter 106 which extends from the very front to the very back of the half shell sweeping down and across on the back 82.

FIGS. 4 and 4A-4E illustrate the right half shell 38. The exterior of the half shell 38 is substantially identical to the shell 36, but a mirror image thereof. In particular, the half shell has a battery shelf 102' which is the same as 102 but a mirror image, a flange 104' which is the same as the flange 104, but a mirror image, and a gutter 106' which is the same as 106 but a mirror image. The shell 38 has three through bores 108, 110, 112, a trigger pivot support 114, and a hinge axle socket 116. The through bores 108, 110, 112, are dimensioned to receive self tapping screws 118, 120, 122 (FIG. 1) which thread into the hollow connecting posts 80,90, 92 (FIG. 3) of the left half shell.

Figure 5:
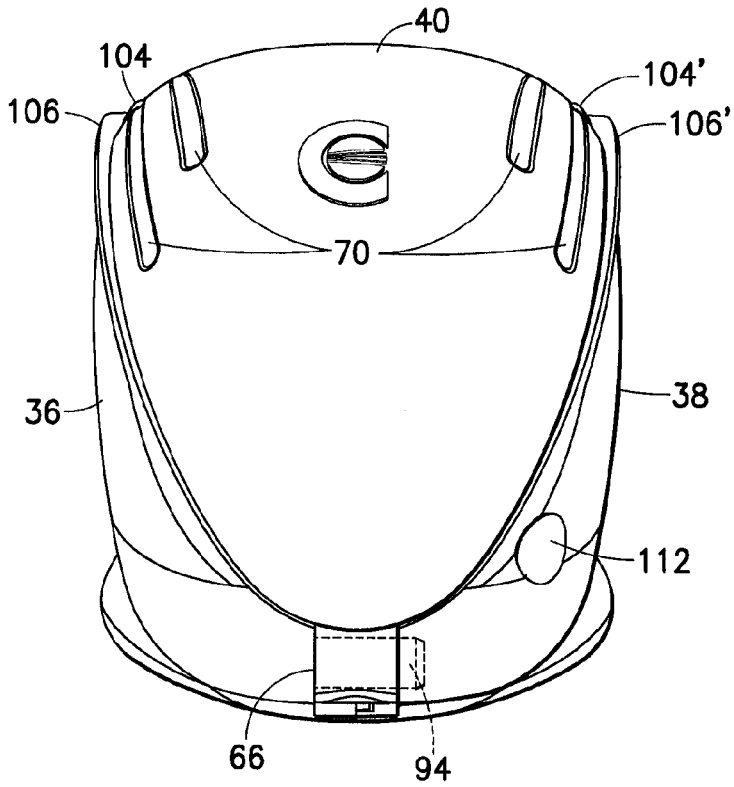
FIG. 5 is a transparent rear elevational view of the three component housing assembled.
Figure 6:
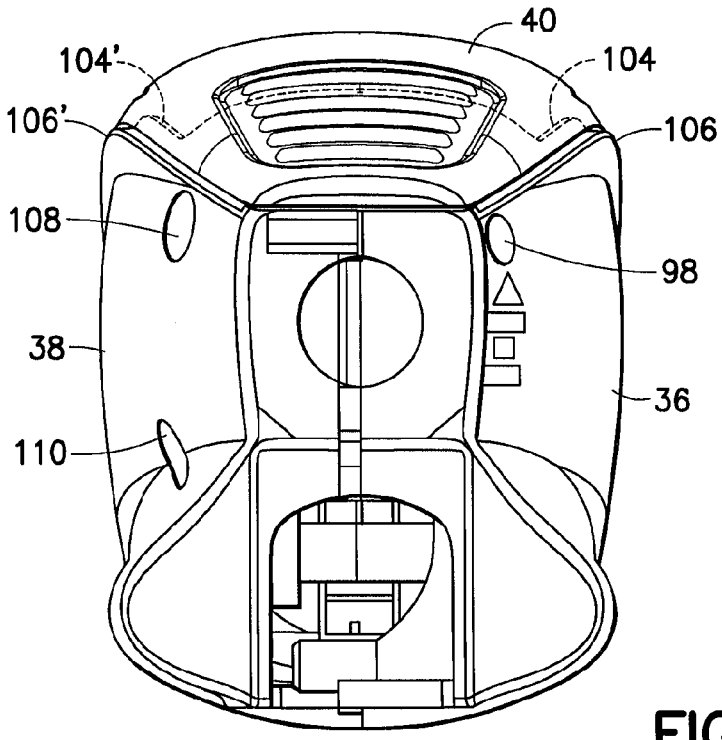
FIG. 6 is a transparent front elevational view of the three component housing assembled.

Referring now to all of the figures, when the three pieces are assembled as shown in FIGS. 5 and 6, batteries 42 are located on the battery shelves 102, 102' directly beneath the cover 40. The hinge member 66 of the top 40 is pivotally mounted on the axle 94. When the top 40 is closed as shown, the front catch 76 is engaged by the catch member 78*b* of the latch 78. A portion of the cylindrical member 78*a* extends into the bore 98 (but preferably remains recessed within it) biased by the spring portion 78*c* of the latch 78. This prevents the top cover 40 from opening on its own. In order to unlatch the cover, a pin or a stylus is inserted into the bore 98 which moves the recessed cylindrical member 78*a* against the spring 78*c* and moves the catch 78*b* out of engagement with the catch 76 on the cover. While holding the latch 78 in this manner, the friction surface 68 on the front of the cover is used to lift the cover and pivot it open on the axle 94.

When the cover is closed as shown in FIGS. 5 and 6, the flanges 104, 104' extend into the cover and the lower edge of the cover is nested between the gutters 106, 106'. Thus, there is no seam between the top cover and the opening to the batteries through which liquid can enter to damage the batteries. Moreover, if liquid should fall on top of the cover 40, it will be directed towards the bottom back of the housing by the gutters 106, 106' and the grooves 70 or towards the front of the housing by the gutters 106, 106'.

There have been described and illustrated herein a battery operated spray head having an improved housing. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as claimed.

What is claimed is:

1. A housing for a battery powered spray head, comprising:

a left side wall and a right side wall coupled to each other and defining an enclosure having a battery space for storing at least one battery;

a battery cover pivotally coupled to at least one of said left and right side walls and being movable from a first position which covers said battery space to a second position wherein said battery space is uncovered, said battery cover having an interior catch member; and a biased latch member located in said enclosure, said latch member engaging said catch member when said battery cover is in said first position, wherein one of said side walls has a through bore that is separate and distinct from said biased latch member, said through bore leading to and aligned with said biased latch member whereby said biased latch means is disengaged from said catch member by inserting a stylus into said through bore.

2. A housing according to claim 1, wherein:

said biased latch member is a unitary member which includes a rod, a catch and a spring.

3. A housing according to claim 2, wherein:

said rod extends in to said through bore but remains recessed relative to the outer surface of said side wall having said through bore.

4. A housing according to claim 2, wherein:

said catch extends radially from said rod.

5. A housing according to claim 2, wherein:

said spring is substantially V-shaped.

6. A housing according to claim 1, wherein:

said battery cover has a friction gripping surface on its exterior.

7. A housing according to claim 1, wherein:

said battery cover pivots on a rod extending between said left and right side walls at a lower rear portion thereof.

8. A battery powered spray head, comprising:

an inlet tube;

an electric pump coupled to said inlet tube;

an outlet nozzle coupled to said electric pump; and a housing containing said electric pump and at least a portion of said outlet nozzle, wherein said housing includes a left side wall and a right side wall coupled to each other and defining an enclosure having a battery space for storing at least one battery;

a battery cover pivotally coupled to at least one of said left and right side walls and being movable from a first position which covers said battery space to a second position wherein said battery space is uncovered, said battery cover having an interior catch member; and a biased latch member located in said enclosure, said latch member engaging said catch member when said battery cover is in said first position, wherein one of said side walls has a through bore that is separate and distinct from said biased latched member, said through bore leading to and aligned with said biased latch member whereby said biased latch means is disengaged from said catch member by inserting a stylus into said through bore.

9. A spray head according to claim 8, wherein:

said biased latch member is a unitary member which includes a rod, a catch and a spring.

10. A spray head according to claim 9, wherein:

said rod extends in to said through bore but remains recessed relative to the outer surface of said side wall having said through bore.

11. A spray head according to claim 9, wherein:

said catch extends radially from said rod.

12. A spray head according to claim 9, wherein:

said spring is substantially V-shaped.

13. A spray head according to claim 8, wherein:

said battery cover has a friction gripping surface on its exterior.

14. A spray head according to claim 8, wherein:

said battery cover pivots on a rod extending between said left and right side walls at a lower rear portion thereof.

* * * * *